US006575057B1

(12) United States Patent
Ploeger

(10) Patent No.: US 6,575,057 B1
(45) Date of Patent: Jun. 10, 2003

(54) BROKEN HEATER HOSE COUPLER REMOVAL TOOL AND METHOD OF USE

(75) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 10/124,970

(22) Filed: Apr. 18, 2002

(51) Int. Cl.[7] ..... B25B 13/50
(52) U.S. Cl. ..... 81/53.2; 81/441
(58) Field of Search ..... 81/53.2, 441

(56) References Cited

U.S. PATENT DOCUMENTS

| | | | | |
|---|---|---|---|---|
| 1,093,252 A | | 4/1914 | Carnes | |
| 1,547,944 A | | 7/1925 | Murphree | |
| 1,590,200 A | | 6/1926 | McGuckin | |
| 1,604,032 A | | 10/1926 | Ferrell | |
| 1,741,349 A | * | 12/1929 | Sullivan | 81/441 |
| 1,875,484 A | * | 9/1932 | Nigra | 81/53.2 |
| 2,121,197 A | | 6/1938 | Jackman | |
| 2,538,343 A | | 1/1951 | Van Winkle, Jr. | |
| 2,931,265 A | * | 4/1960 | De Lacy | 411/403 |
| 3,161,090 A | | 12/1964 | McLellan | |
| 3,335,580 A | * | 8/1967 | Simpson, Jr. | 464/160 |
| 3,354,757 A | | 11/1967 | Grimm et al. | |
| 4,328,720 A | | 5/1982 | Shiel | |
| 4,492,500 A | * | 1/1985 | Ewing | 411/393 |
| 4,572,035 A | | 2/1986 | Eisenhauer | |
| 4,607,547 A | | 8/1986 | Martus | |
| 4,671,141 A | | 6/1987 | Hanson | |
| 4,685,823 A | * | 8/1987 | Nephi | 29/558 |
| 4,716,793 A | | 1/1988 | Tauber | |
| 4,805,495 A | | 2/1989 | Tauber | |
| 4,993,289 A | | 2/1991 | Parks | |
| 5,019,080 A | * | 5/1991 | Hemer | 411/402 |
| 5,251,516 A | | 10/1993 | Desaulnieres | |
| 5,301,573 A | | 4/1994 | Weber et al. | |
| 5,513,545 A | | 5/1996 | George | |
| 5,551,320 A | | 9/1996 | Horobec at al. | |
| 5,582,496 A | | 12/1996 | Ambrico | |
| 5,690,004 A | | 11/1997 | Weber | |
| 5,737,981 A | | 4/1998 | Hildebrand | |
| 5,904,076 A | | 5/1999 | Siwy | |
| 5,907,983 A | | 6/1999 | Spirer | |
| 6,003,411 A | | 12/1999 | Knox | |
| 6,047,620 A | | 4/2000 | Kozak et al. | |
| 6,098,499 A | * | 8/2000 | Pool | 81/441 |

OTHER PUBLICATIONS

The Damaged Nut & Bolt Removers, Inshalla Products Inc., Tampa FL.

* cited by examiner

*Primary Examiner*—Joseph J. Hail, III
*Assistant Examiner*—Hadi Shakeri
(74) *Attorney, Agent, or Firm*—Banner & Witcoff, Ltd.

(57) ABSTRACT

A tool for the removal of a broken heater hose coupler from an engine block includes a symmetrical driving tool with twelve teeth or splines for engagement with the broken coupler so that a wrench may be applied to the opposite end of the tool to twist and unthread the coupler from the engine block.

3 Claims, 1 Drawing Sheet

14
12
16
3.
4.
20
10
18
3.
4.

16
20
12

28
24
26
42
25
24
22
29
R1
R2
18

22
28
40
42
26
24
42
24
R3
20

53
14
18
20

54
50
52

12
24
18
20

24
26
40
28
25

BROKEN HEATER HOSE COUPLER REMOVAL TOOL AND METHOD OF USE

BACKGROUND OF THE INVENTION

In a principal aspect, the present invention relates to a specialized tool for removal of a broken heater hose coupler from an engine block. The tool is formed with a special array of splines that may be driven into the broken heater hose coupler to provide for gripping of the coupler in a manner which facilitates rotation and removal of the broken coupler from the block.

The heater hose connection for many motor vehicles is often attached to the engine block by means of a coupler. Some couplers are made from steel, but most are made of die cast zinc. Typically, couplers are in the form of a tube with outside threads at one end that screw into the block. The opposite end typically includes a hose clamp or bayonet connection for a hose.

The die cast zinc couplers often corrode and break along the thread line where the coupler is attached to the engine block. A broken coupler must, therefore, be replaced, but cannot be removed in a conventional manner by unscrewing the coupler from the block inasmuch as the threaded section of the coupler is lodged in the block and the portion projecting from the box has been broken and removed. Thus, there has developed a need to provide a means and tool for removal of a die cast zinc, threaded coupler section remaining within the threaded opening in the engine block.

SUMMARY OF THE INVENTION

Briefly, the present invention comprises a tool for removal of a broken heater hose coupler from an engine block. A projecting portion of the coupler has been broken and a threaded section remains in the block but cannot be removed by conventional means, for example, unthreading by means of a wrench, pliers or the like. The tool of the invention comprises an elongate rod having a polygonal shank at one end and a plurality of substantially identical splines at the other end. Twelve splines are symmetrically arranged around a longitudinal axis at the working end of the tool. The spline, working end portion of the tool is divided into two sections; namely, a mid region and an end region. The splines in the mid region are crested by walls joined at an apex and having a triangular cross section; whereas the splines in the end region have a truncated cross section. The opposite polygonal end of the tool includes a surface for driving the tool into the portion of the coupler remaining in the engine block. The shape or configuration of the splines enables the tool to effectively and efficiently interface and grip the coupler section so that a wrench or other tool may be applied to the polygonal end of the tool to impart rotation and removal of the coupler section.

Thus, it is an object of the invention to provide an improved tool for removal of a broken heater hose coupler from an engine block.

It is a further object of the invention to provide a tool for removal of a broken heater hose coupler from an engine block which may be driven into the coupler section in the engine block to thereby grip the coupler section so that it may be twisted or turned and unthreaded from the block.

Another object of the invention to provide a tool for removal of a broken heater hose coupler from an engine block which includes twelve, symmetrical splines arranged a uniform radial distance from the center line longitudinal axis of the tool and wherein each of the splines has a substantially identical construction thus providing a symmetric configuration and cross section.

It is a further object of the invention to provide a rugged, inexpensive and highly efficient tool for removal of a broken heater hose coupler from an engine block.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
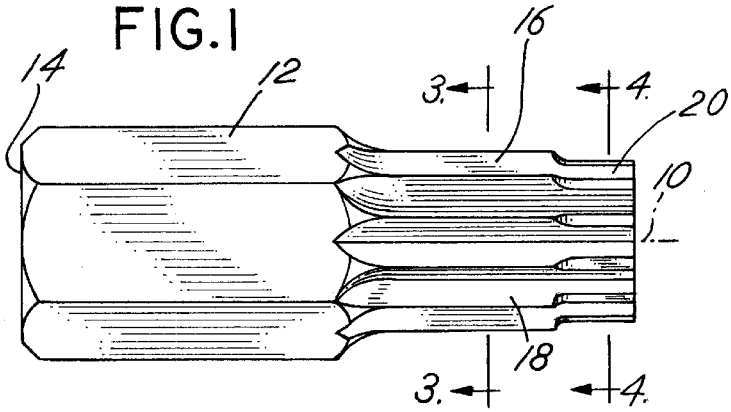
FIG. 1 is a side elevation of the tool of the invention.

Referring to the figures, the tool is generally symmetrical around a longitudinal, center line axis 10. The tool thus includes a shank end 12 having a generally polygonal cross section, for example, a hexagonal cross section, so that it may be easily driven or turned by a wrench or similar tool. A transverse planar flat driving surface 14 is preferably perpendicular to the axis 10. Preferably, the tools are approximately two (2) inches in length along the longitudinal axis 10 and the shank section or shank 12 comprises approximately one-half of that dimension, or one (1) inch.

Figure 3:
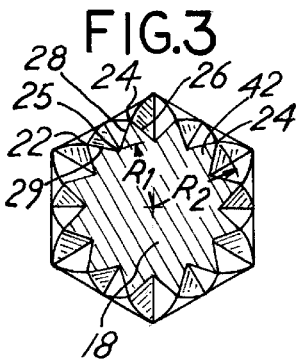
FIG. 3 is a cross sectional view depicting the configuration of the splines in the mid region of the tool.

The opposite end of the tool comprises a spline section 16 which is adapted to engage the broken portion of a hose coupler in an engine block as described hereinafter. The spline section 16 is symmetric about the center axis 10 and includes a mid section 18 and an end section 20. The mid section 18 and end section 20 comprise twelve identical splines, for example, spline 22. In the mid section as depicted in FIG. 3, the spline 22 includes an apex 24, a first diverging sidewall or face 26 and a second diverging sidewall or face 28. Adjacent diverging faces 29, 28 of adjacent splines 22 intersect at a 90° angle or a right angle. Adjacent converging faces 26, 28 intersect at a 60° angle. Thus, the splines 22 comprise pointed teeth or ribs in cross section in the mid region 18. The ribs, teeth or splines 22 are arrayed symmetrically about the center line axis 10. Thus, each quarter section of the cross section of the tool includes three splines or teeth 22. The apex, crest or peaks 24 of each of the teeth 22 have equal radii, $R_2$. The valley 25 between each tooth 22 is defined by a second radius $R_1$.

Figure 2:
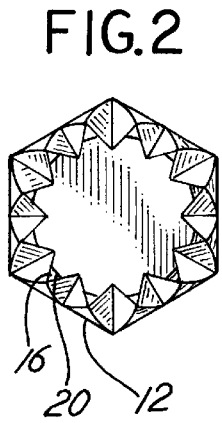
FIG. 2 is an end view of the tool of FIG. 1.
Figure 4:
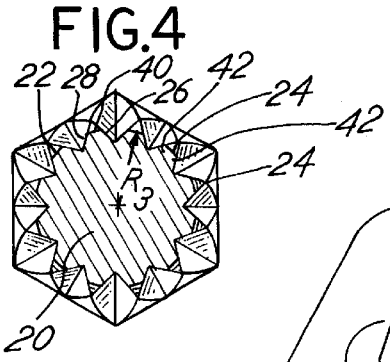
FIG. 4 is a cross sectional view taken along the line of 4—4 in FIG. 1.

FIG. 4 depicts the cross section of the construction associated with the end section or portion 20 of the spline section 16. Thus, FIG. 4, as well as FIG. 2, illustrates the cross sectional shape of the tool along the line 4—4. The splines or teeth, or ribs 22 of end section 20 are extensions or continuations of the teeth 22 associated with the mid section 16, except that the teeth 22 in end section 20 are truncated in cross section by virtue of a radius surface 40 having radius $R_3$ which connects opposite faces 26, 28 of each tooth or spline 22. The amount of truncation is approximately ⅓ of the depth of the rib or tooth 22 to define a radius $R_2$. Thus, the truncated section 42 of tooth 22 is defined by three surface facets, or faces; namely, the partial faces 26, 28 and the truncated face 40.

The longitudinal extent of the end section or truncated tooth section 20 is approximately one-half of the longitudinal extent of the midsection 18. A typical radius $R_2$ associated with the apex 24 is in the range of 0.23±0.005 inches.

Figure 6:
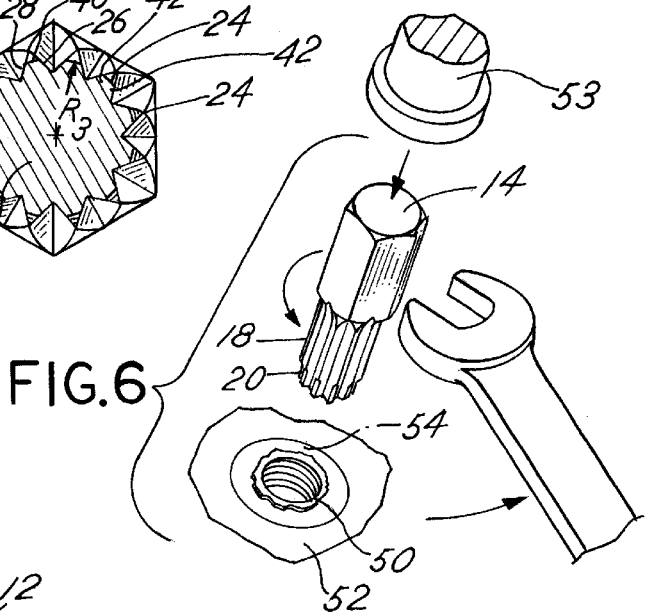
FIG. 6 is an isometric view illustrating the use of the tool of FIG. 1.
Figure 5:
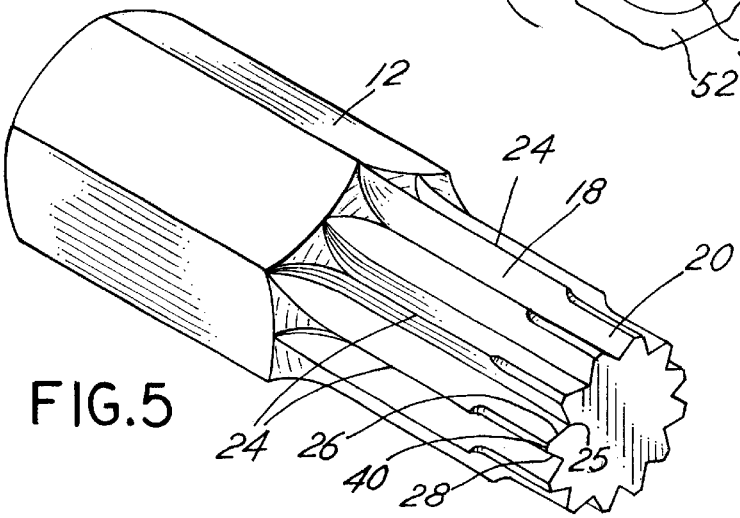
FIG. 5 is an isometric view of the tool of FIG. 1.

As depicted in FIG. 6, the manner of use of the tool requires positioning the ribbed or splined sections 18, 20 into the portion of the broken coupler 50 retained within the engine block 52 in a manner which aligns the axis 10 with the center line axis 54 of the coupler 50. The tool is then driven down into the coupler 50 in a manner which engages the crests of the peak 24 of the teeth 22 with the coupler 50. That is, the truncated portions or section 20 of the ribs, teeth or crest 22 form an initial guide mechanism or pathway for movement of the tool into the opening defined by the broken coupler 50. The crest 24 of the teeth 22 then will be driven into the coupler 50 by engaging a hammer 53 against the surface 14. Thereafter, a wrench, pliers or the like is gripped on the polygonal head 12 and the coupler 50 is unthreaded from the engine block.

Variations of the tool may be implemented. For example, the size and array of the teeth may be varied slightly. Twelve teeth or ribs are preferred. The dimensions of the teeth or ribs may be varied including the longitudinal dimensions as well as the radial dimensions. The shank may be polygonal or include other internal or external drive/rotation configurations. Thus, the invention is to be limited only by the following claims and equivalents thereof.

What is claimed is:

1. A tool for removal of a broken heater hose coupler from an engine block, said coupler of the type threadably engaged in a bore passage in the block and projecting from the block, said projecting portion susceptible to breakage from the coupler thereby leaving a section of the threaded coupler in the block, said tool comprising:

(a) an elongate rod having a first end and a second end, a longitudinal, center line axis with a shank at the first end of said rod and a plurality of splines at the second end of said rod for driving engagement with the coupler section in the block;

(b) said splines in the form of a symmetric array of crested teeth radially spaced from and parallel to the axis, said splines defining an end region at the second end and an adjacent mid region, the cross sectional configuration of the mid region teeth consisting of equally sized ribs, each rib having a first face and a second face, each of said first and second faces of each rib intersecting at an apex parallel to the axis, and the first face of each rib intersecting the second face of the next adjacent rib to define a valley, the first and second adjacent faces of adjacent ribs parallel to the axis and intersecting at a right angle, and the cross sectional configuration of the end region at the second end congruent with the cross sectional configuration of the mid region said ribs being truncated at the end region at the second end to define a radius surface parallel to the axis; and (c) said shank including a driving face transverse to the axis.

2. The tool of claim 1 wherein the first and second adjacent faces intersect at a substantially sixty degree angle.

3. The tool of claim 1 comprising twelve ribs.

* * * * *